United States Patent [19]

Jung-Chi

[11] Patent Number: 4,531,634

[45] Date of Patent: Jul. 30, 1985

[54] INSTANT VELCRO ASSEMBLY

[76] Inventor: Lai Jung-Chi, Rm. 8 9th Fl., No. 20 Min Chuan W. Rd., Taipei, Taiwan

[21] Appl. No.: 565,696

[22] Filed: Dec. 27, 1983

[51] Int. Cl.[3] ..... B65H 37/04; B65H 19/04; B65D 85/67; B65D 85/671

[52] U.S. Cl. ..... 206/391; 206/409; 206/461; 206/346; 242/55.3

[58] Field of Search ..... 206/409, 461, 391, 338, 206/346; 242/55.3

[56] References Cited

U.S. PATENT DOCUMENTS

| | | | |
|---|---|---|---|
| 1,289,136 | 12/1918 | Elliott | 206/346 |
| 3,302,781 | 2/1967 | Rudnick | 206/391 |
| 3,353,663 | 11/1967 | Kayser et al. | 206/346 |
| 3,403,869 | 10/1968 | Marchisen et al. | 206/461 |
| 3,841,475 | 10/1974 | Ellis | 206/461 |
| 4,088,275 | 5/1978 | Ramos | 242/55.3 |

FOREIGN PATENT DOCUMENTS

| | | | |
|---|---|---|---|
| 0075485 | 3/1983 | European Pat. Off. | 242/55.3 |

*Primary Examiner*—William T. Dixson, Jr.
*Attorney, Agent, or Firm*—Erik M. Arnhem

[57] ABSTRACT

It is an instant and simple VELCRO improvement, and it has a male tape roll and a female tape roll being packed together in one plastic case. The two rolls of tape will be pressed and fastened together upon being pulled out the case so as to facilitate further processing.

2 Claims, 1 Drawing Figure

INSTANT VELCRO ASSEMBLY

BACKGROUND OF THE INVENTION

Ever since being invented, VELCRO has widely been used in our daily life, and it is likely going to replace the zipper and the button. It has been used for folding edges of garments, the closing portion of a handbag, the buckle position of a belt, and the spot where a shoulder patch or an identification badge is to be attached, etc., and it may also be used for replacing the shoe-lace or fastening belt of articles. For the general articles, it seems being not proper or ill appearance upon using a VELCRO because of the VELCRO consisting of two parts, i.e., the male tape and the female tape, which are to be sewed on suitable and exact opposite positions with the same size. Upon being sewed on a spot and fastened together, the two parts of VELCRO often become equally disposed or being not straight as it should as a result of incorrect size measured and cut or incorrect sewing or attaching method. Generally, before sewing or attaching the VELCRO on a spot, fasten the male tape and the female tape together, and then cut into a size desired; then, put the VELCRO in position and apply with an adhesive or the like, or sew the VELCRO in corresponding position; finally, it may be pulled apart or pressed together for normal use. In either of the said cases, the VELCRO must be pressed together first prior to being cut for use. In case of positioning and pressing two long tapes (male and female) of VELCRO accurately, it is a matter of difficulties and to waste time as well. The two parts of VELCRO can not be pressed together before leaving the factory because of the VELCRO unable to be rolled up as a result of its intrinsic thickness. The pressed VELCRO can not be stored in flat manner because of being too long to make packing difficult. Therefore, the two tapes of VELCRO in the market for sale are usually packed and rolled up separately. That way of packing has rendered the user much inconvenient. Now, the problem is how to have a separately rolled up VELCRO pressed together at once upon being used. In order to meet that requirement, the present invention has made an improvement on the existing VELCRO without requiring additional costs or materials.

SUMMARY OF THE INVENTION

This invention relates to an instant VELCRO assembly, in which the conventional male and female tapes of a VELCRO are rolled up separately to form into "8" shape with only a very short terminal part being pressed together; the two rolls are packed into a transparent plastic case, which is attached to a piece of cardboard. The short pressed terminal part of the two VELCRO tapes may be pulled out of an outlet in the middle portion of the transparent plastic case; in other words, upon the two parts of VELCRO being pulled out of the outlet, the VELCRO will be pressed together automatically so as to facilitate cutting into any length desired. The convenient features of the present invention will become more prominent upon more or longer pieces of VELCRO to be used.

DETAILED DESCRIPTION

Figure 1:
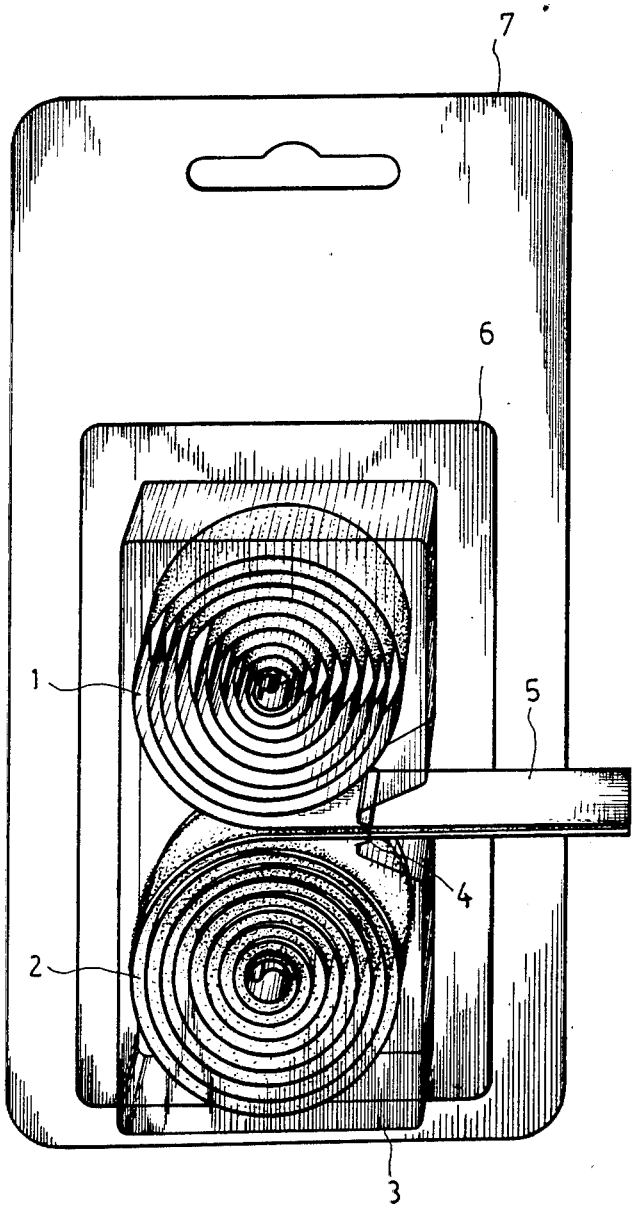
FIG. 1 is a perspective view of the present invention.

This invention relates to an instant VELCRO assembly as shown in FIG. 1, in which the adhering faces of both the male tape 1 and female tape 2 are rolled up outwards separately. The purpose of the rolling of that tapes is to reduce its packing size for facilitating the storage thereof. The transparent plastic case 3 is made in a shape to fit and to accommodate rolled-up shape of both the male and female taped (1) and (2), and is attached with its edge 6 to a cardboard 7; the rolls of VELCRO may be rotated freely in said case. At one side in the middle of the transparent plastic case 3, an outlet 4 is furnished, and it is actually a slot, of which the length is equal to the width of the VELCRO, while the width thereof is equal to the thickness of the VELCRO; the purpose that identical sizes is to have the male 1 and female 2 tapes pressed together upon being pulled out of the outlet 4 as shown with the segment pulled out.

In use, the VELCRO pulled out will be in a neatly and tidily pressed condition, and the length to be pulled out may be depending upon the length required; then, cut it into a predetermined pieces or length before being attached to an article. This way will save a lot of labor and time, and material for just attaching the VELCRO to an article as usual.

I claim:

1. An instant VELCRO assembly comprising:

a rolled-up male tape, which is a part of the VELCRO with its adhering face facing outwards and being packed in one portion of a transparent plastic case;

a rolled-up female tape, which is a part of the VELCRO with its adhering face facing outwards and being packed in one portion of said transparent plastic case abreast with said male tape;

a transparent plastic case, which is moulded into shape and attached, with its edge, to a cardboard for housing said male and female tapes, and which is also furnished with an outlet in the middle at one side, thru which the male and female tapes are pressed together upon being pulled out; and a cardboard, which is the base of this assembly.

2. An instant VELCRO assembly as claimed in claim 1, wherein the outlet at one side in the middle of said transparent plastic case is used for pressing the male and female tapes together tidily upon being pulled out.

* * * * *